US012415142B2

(12) United States Patent
Cheng

(10) Patent No.: US 12,415,142 B2
(45) Date of Patent: Sep. 16, 2025

(54) MOTION SIMULATING APPARATUS AND ACTUATING SYSTEM

(71) Applicant: Brogent Technologies Inc., Kaohsiung (TW)

(72) Inventor: Tien-Ni Cheng, Kaohsiung (TW)

(73) Assignee: Brogent Technologies Inc., Kaohsiung (TW)

( * ) Notice: Subject to any disclaimer, the term of this patent is extended or adjusted under 35 U.S.C. 154(b) by 498 days.

(21) Appl. No.: 18/097,919

(22) Filed: Jan. 17, 2023

(65) Prior Publication Data

US 2023/0381676 A1 Nov. 30, 2023

(30) Foreign Application Priority Data

May 31, 2022 (TW) ..... 111120259

(51) Int. Cl.
*A63G 31/14* (2006.01)

(52) U.S. Cl.
CPC ..... *A63G 31/14* (2013.01)

(58) Field of Classification Search
CPC ..... A63G 31/14; A63B 22/18; A61H 1/005
USPC ..... 472/48
See application file for complete search history.

(56) References Cited

U.S. PATENT DOCUMENTS 1,454,775 A * 5/1923 Unger ..... A63G 31/14 472/48
5,009,412 A * 4/1991 Roodenburg ..... A63G 31/00 472/136
5,921,899 A * 7/1999 Rose ..... A63B 22/18 482/77

FOREIGN PATENT DOCUMENTS

CN 111243374 B * 12/2021 ..... G09B 9/02
FR 3110565 A1 * 11/2021 ..... A63J 25/00

* cited by examiner

*Primary Examiner* — Alexander K Garlen
(74) *Attorney, Agent, or Firm* — Birch, Stewart, Kolasch & Birch, LLP

(57) ABSTRACT

A motion simulating apparatus and actuating system includes a base; a movable platform arranged above the base; a first cross arm assembly disposed on a first side between the base and the movable platform. The first cross arm assembly includes a first arm and a second arm that are cross-connected to each other; a second cross arm assembly disposed on a second side between the base and the movable platform relative to the first side. The second cross arm assembly includes a third arm and a fourth arm forming an X-shaped connection; an actuator connected obliquely to an upper part of the first arm and the base or the lower part of the third arm to drive the movable platform to move along a first direction or its opposite direction; and a rod is horizontally connected with the upper part of the first arm and an upper part of the third arm. The base, the movable platform, the first arm and the third arm form a substantially parallelogram when the actuator is actuating.

16 Claims, 8 Drawing Sheets

MOTION SIMULATING APPARATUS AND ACTUATING SYSTEM

CROSS-REFERENCE TO RELATED APPLICATION(S)

This application claims priority to Taiwan patent application no. 111120259 filed on May 31, 2022.

BACKGROUND

1. Field of the Invention

The present invention relates to a motion simulating apparatus, and more particularly, to a motion simulating apparatus equipped with actuating systems.

2. Description of the Related Art

Motion simulators may be typically used as amusement or training equipment. Generally, a motion simulator includes a plurality of actuators that are respectively disposed at different locations and along different axes of movements so as to be able to simulate motions along different axes. In general, a conventional actuator is installed vertically and has a large volume, such that the actuator requires a relatively tall space, which is disadvantageous to the scenario of limited space. Unfortunately, the conventional motion simulators are usually complex in construction and have relatively high manufacturing costs.

Therefore, there is a need for a new construction that can solve the aforementioned issues.

SUMMARY

The present application describes a motion simulating apparatus that can address at least the foregoing issues, and an actuating system incorporating the motion simulating apparatus.

According to one aspect, a motion simulating apparatus described herein includes a base, a movable platform arranged above the base, a first cross arm assembly, a second cross arm assembly, an actuator and a rod. The first cross arm assembly is disposed on a first side between the base and the movable platform, wherein the first cross arm assembly includes a first arm and a second arm that are cross-connected to each other. The second cross arm assembly is disposed on a second side between the base and the movable platform relative to the first side, wherein the second cross arm assembly includes a third arm and a fourth arm that are cross-connected to each other. The actuator is connected obliquely to an upper part of the first arm and the base or a lower part of the third arm, configured to drive the movable platform to move along a first direction or an opposite direction of the first direction. The rod is horizontally connected with the upper part of the first arm and an upper part of the third arm, wherein the base, the movable platform, the first arm and the third arm substantially form a parallelogram when the actuator is actuating.

According to another aspect, an actuating system described herein includes an occupant platform adapted to carry one or more occupants, and a plurality of the motion simulating apparatus. Wherein the movable platform of the motion simulating apparatus is pivotally connected to the occupant platform through a plurality of joint assemblies.

DETAILED DESCRIPTION OF THE EMBODIMENTS

Figure 1:
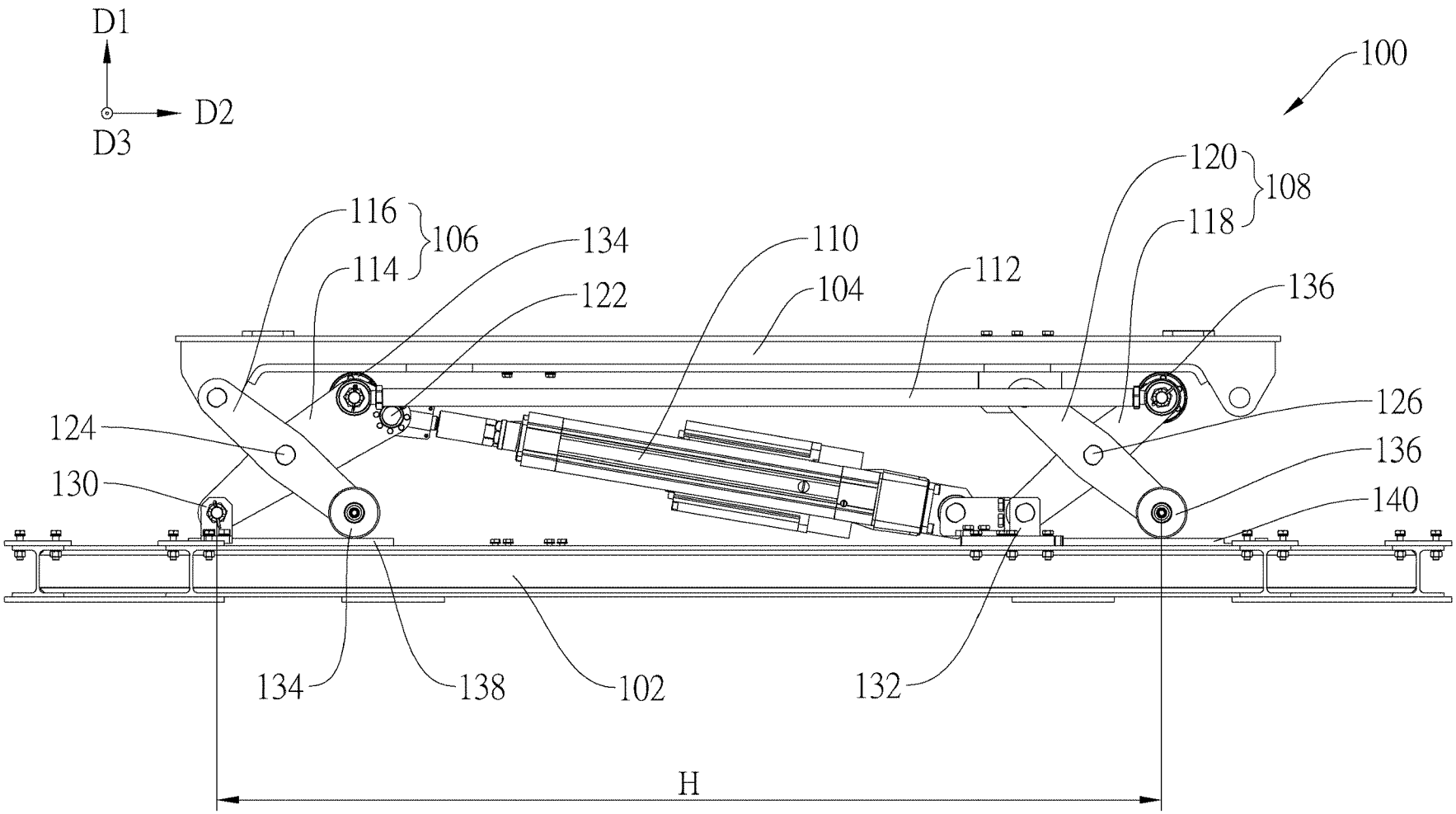
FIG. 1 is a front view illustrating an embodiment of a motion simulating apparatus.
Figure 2:
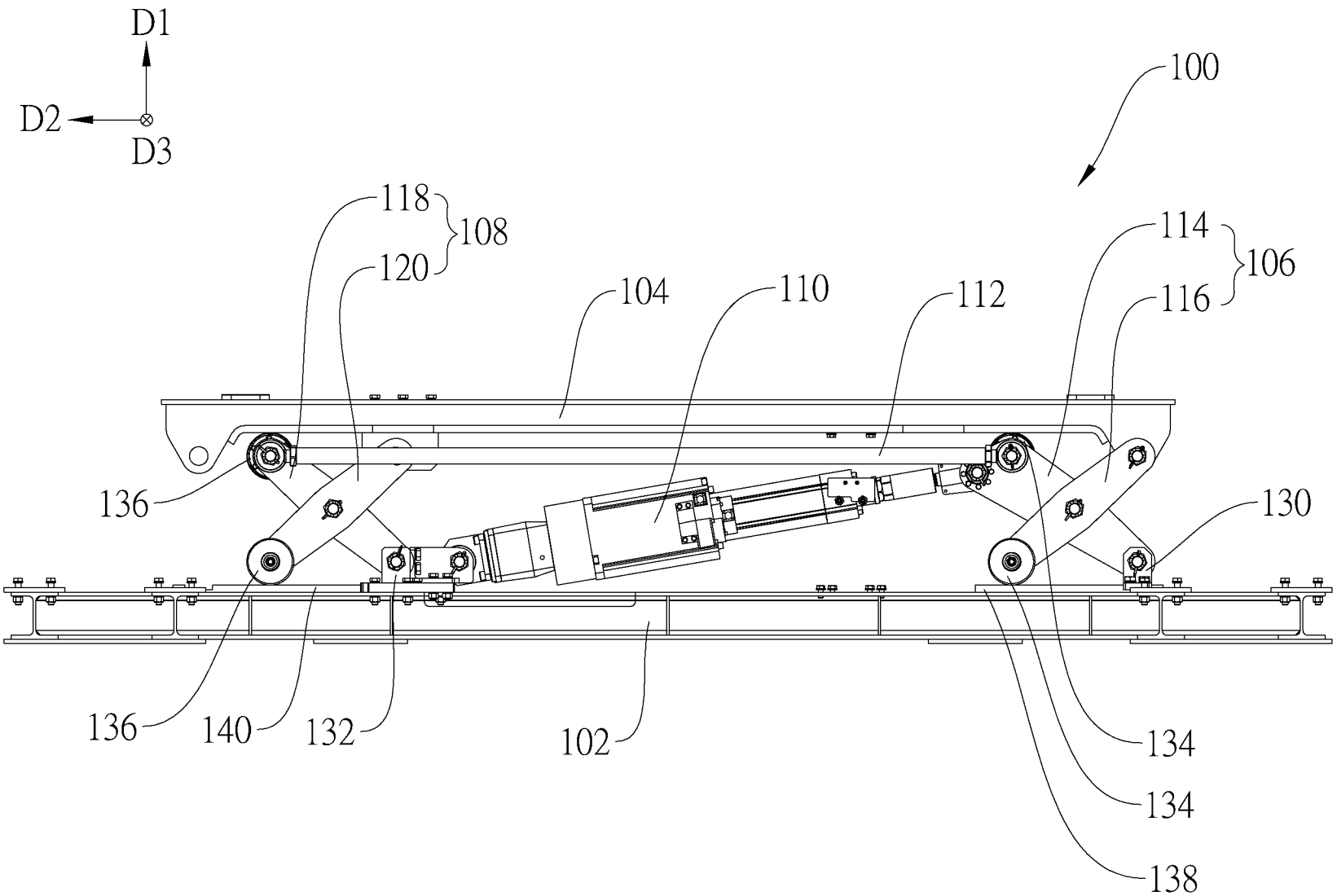
FIG. 2 is a rear view illustrating an embodiment of a motion simulating apparatus.
Figure 3:
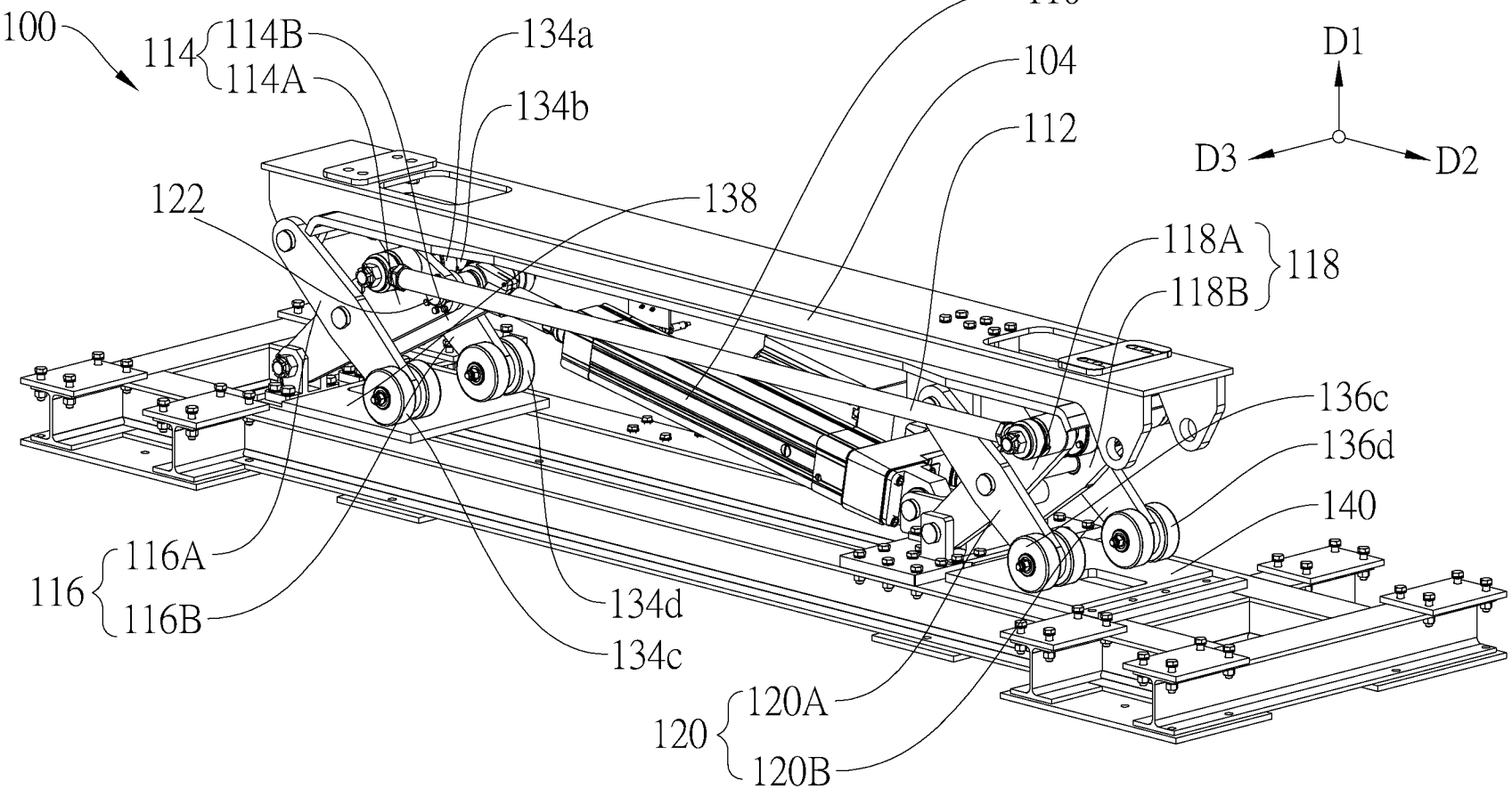
FIG. 3 is a perspective view illustrating an embodiment of a motion simulating apparatus.
Figure 4:
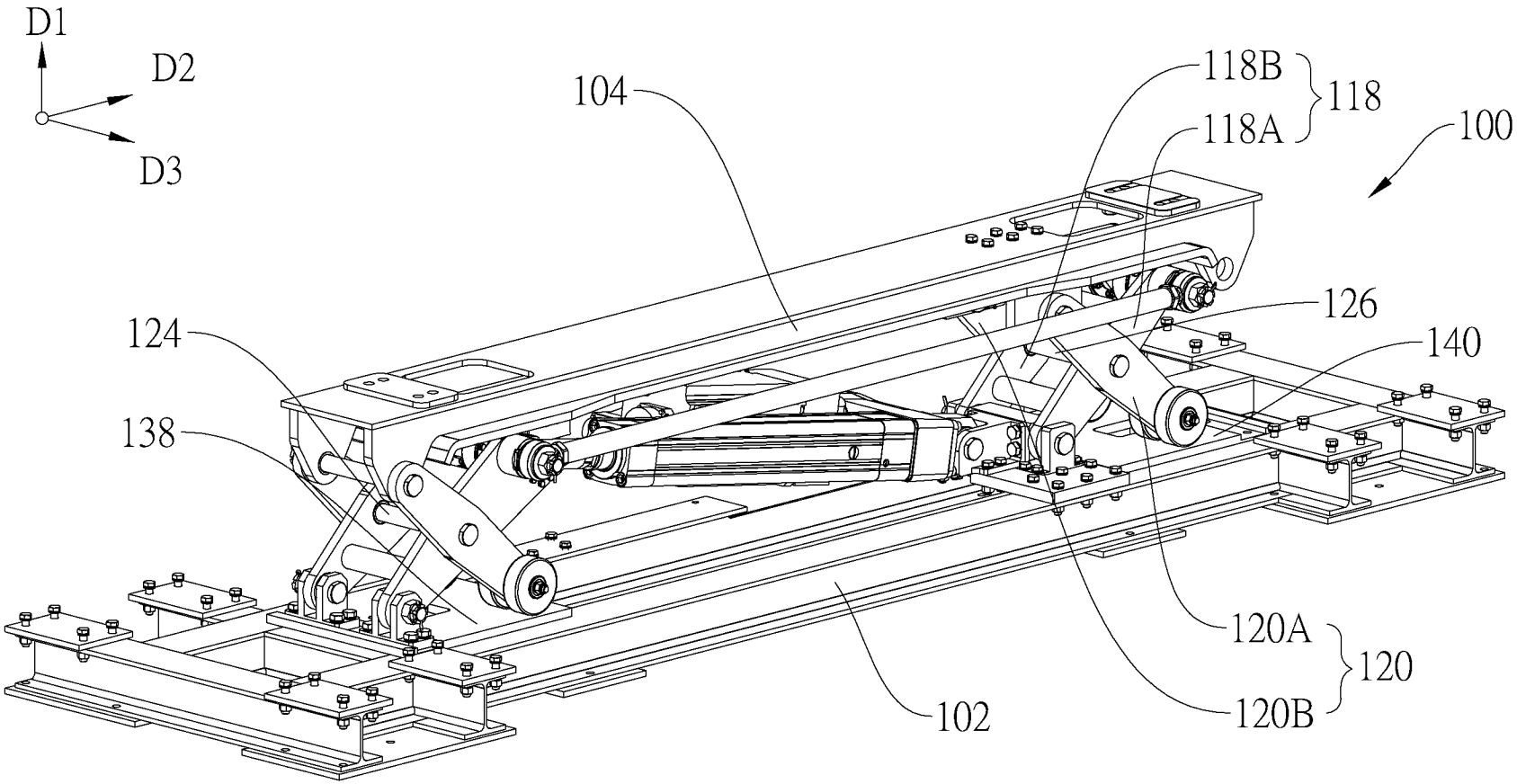
FIG. 4 is a perspective view illustrating an embodiment of a motion simulating apparatus.
Figure 5:
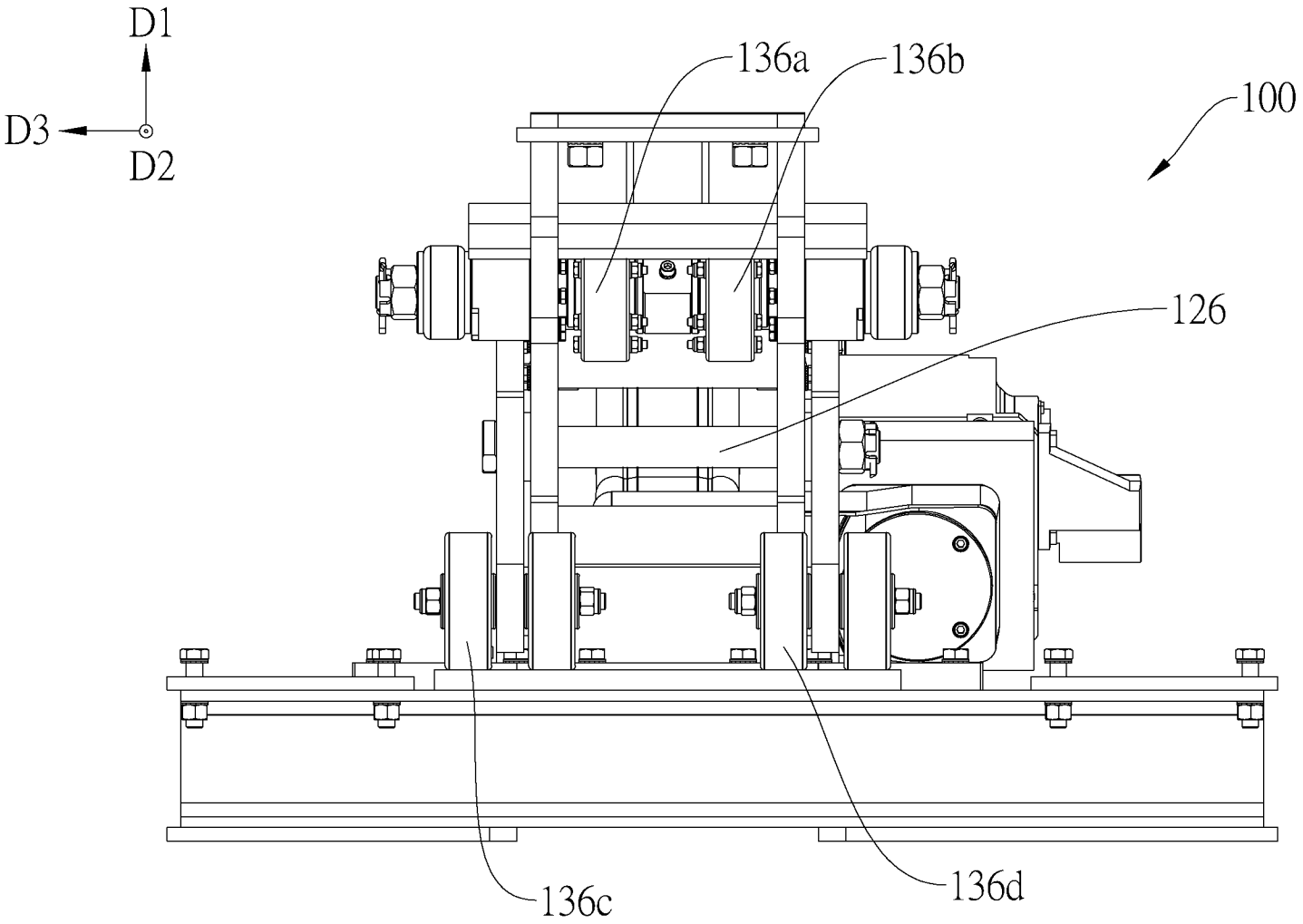
FIG. 5 is a side view illustrating an embodiment of a motion simulating apparatus.
Figure 6:
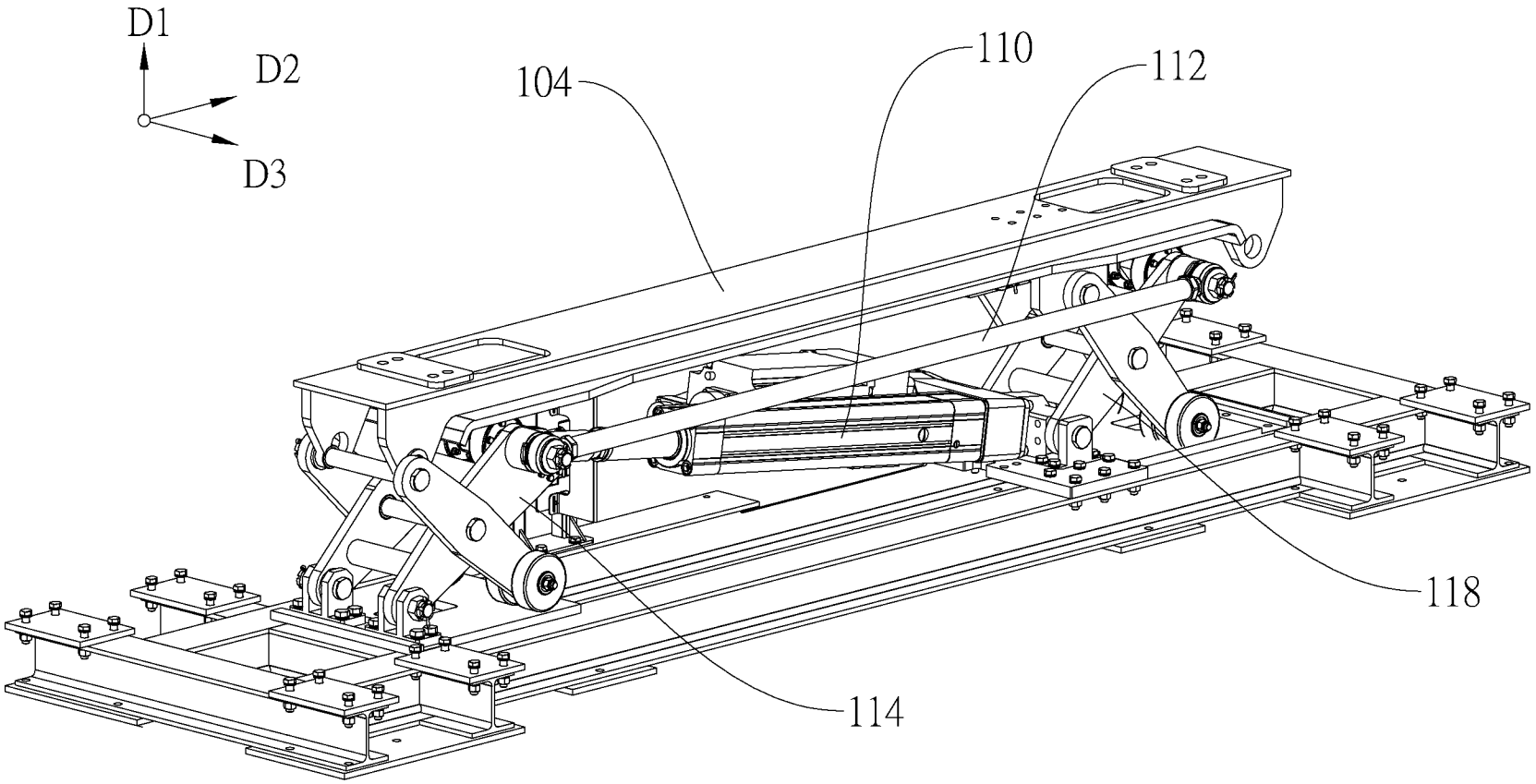
FIG. 6 is a perspective view illustrating an embodiment of a motion simulating apparatus.
Figure 7:
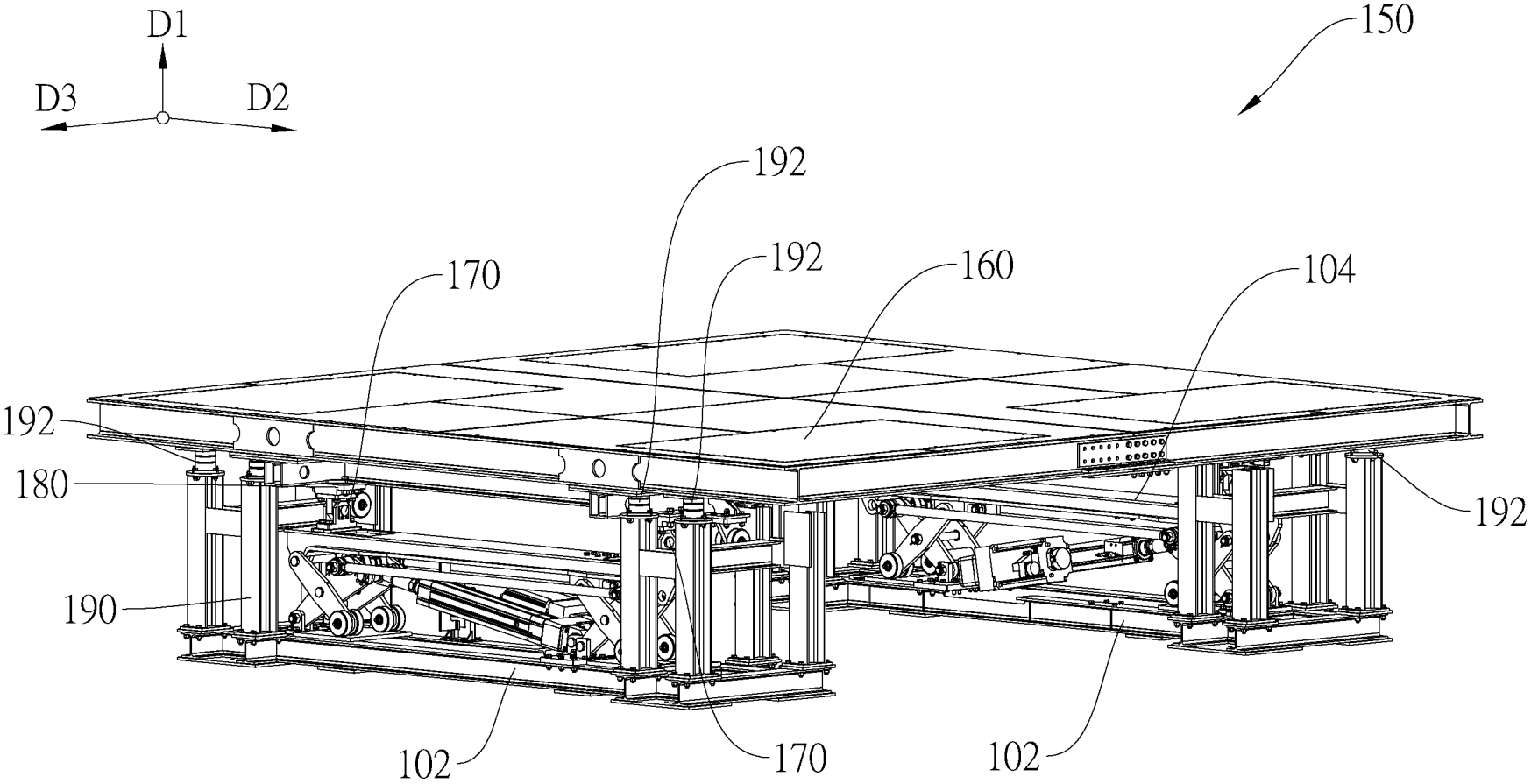
FIG. 7 is a perspective view illustrating an embodiment of an actuating system.
Figure 8:
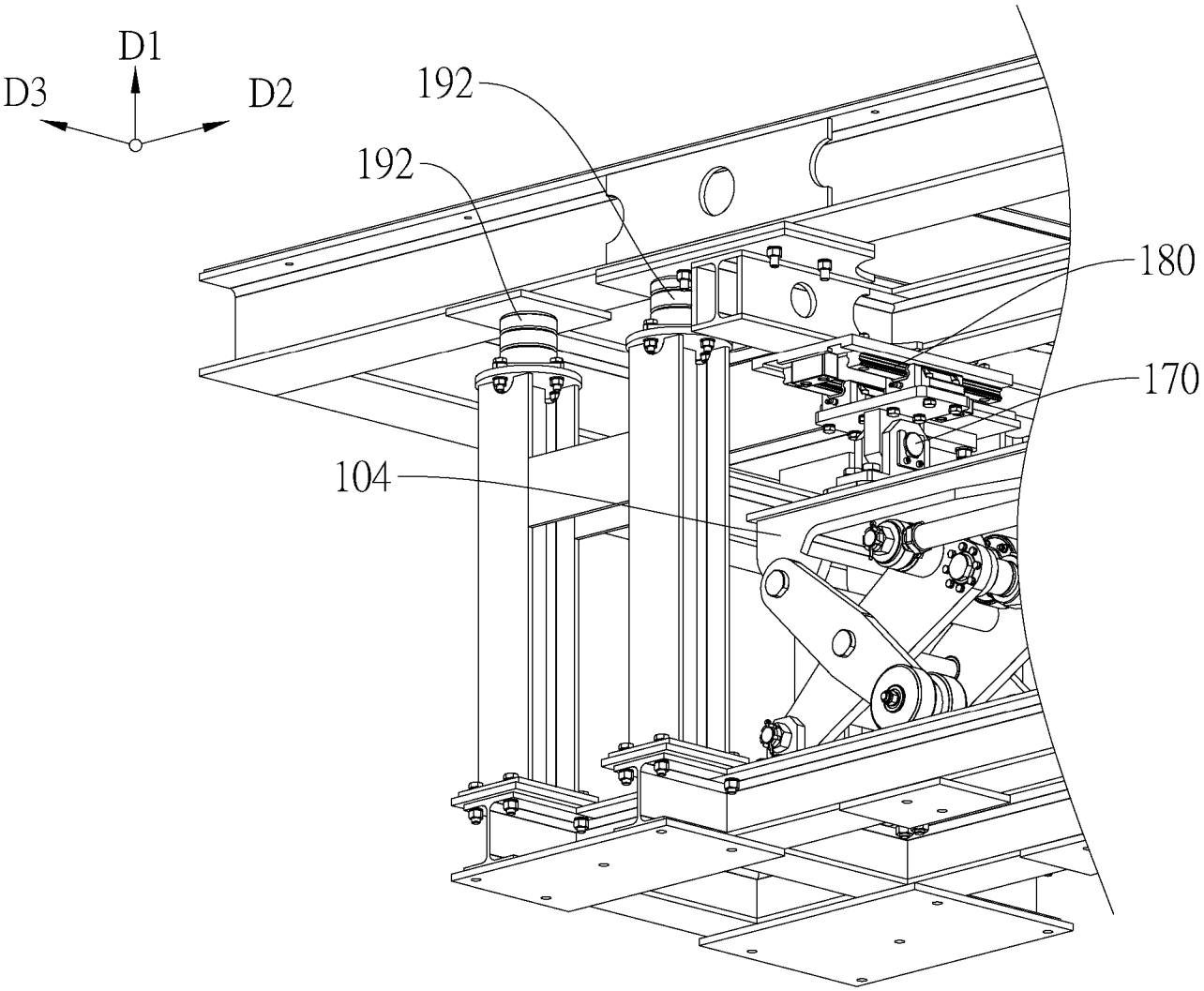
FIG. 8 is an enlarged view illustrating a portion of the actuating system.

FIG. 1 is a front view illustrating an embodiment of a motion simulating apparatus. FIG. 2 is a rear view illustrating an embodiment of a motion simulating apparatus. FIG. 3 and FIG. 4 are perspective views illustrating an embodiment of a motion simulating apparatus. FIG. 5 is a side view illustrating an embodiment of a motion simulating apparatus. FIG. 6 is a perspective view illustrating an embodiment of a motion simulating apparatus. FIG. 7 is a perspective view illustrating an embodiment of an actuating system. FIG. 8 is an enlarged view illustrating a portion of the actuating system. Referring to FIGS. 1-7, a first direction D1, a second direction D2 and a third direction D3 can be substantially orthogonal to each other. The motion simulating apparatus 100 can carry occupants or passengers and generate motions in different directions, which is applicable to various applications such as simulating platforms or amusement equipment. Referring to FIGS. 1-5, the motion simulating apparatus 100 can include a base 102, a movable platform 104, a first cross arm assembly 106, a second cross arm assembly 108, an actuator 110 and a rod 112.

The base 102 is disposed on a horizontal plane (the plane formed by the second direction D2 and the third direction D3). The movable platform 104 is arranged above the base plate 102 and is movably connected to the base 102. The first cross arm assembly 106 and the second cross arm assembly 108 are disposed between the base 102 and the movable platform 104. The first cross arm assembly 106 and the second cross arm assembly 108 are respectively arranged on two opposite sides of the base 102. The first cross arm assembly 106 can include a first arm 114 and a second arm 116 that are cross-connected to each other. The second cross arm assembly 108 can include a third arm 118 and a fourth arm 120 that are cross-connected to each other. According to an embodiment of the present invention, the first arm 114 can be pivotally connected to the second arm 116 through a first pivot member 124, and the third arm 118 can be pivotally connected to the fourth arm 120 through a second pivot member 126, so that first cross arm assembly 106 and the second cross arm assembly 108 can cooperate with the actuation of the actuator 110. According to an embodiment of the present invention, the first cross arm assembly 106 and the second cross arm assembly 108 can both form an X-shaped connection. More specifically, the first arm 114 and the second arm 116 can be connected in an X shape to form a scissor lift structure, and the third arm 118 and the fourth arm 120 can be connected in an X shape to form a scissor lift structure, so as to cooperate with the operation of the actuator 110 to be extended and retracted.

According to an embodiment of the present invention, the first arm 114 can include a first sub-arm 114A and a second sub-arm 114B spaced apart along the third direction D3, and the first sub-arm 114A and the second sub-arm 114B can be pivotally connected through the first pivot member 124. In addition, the second arm 116 can include a third sub-arm 116A and a fourth sub-arm 116B spaced apart along the third direction D3, and the third sub-arm 116A and the fourth sub-arm 116B can be pivotally connected through the first pivot member 124. According to an embodiment of the present invention, the lower side of the first arm 114 is fixedly disposed on the base 102 at a first fixed end 130. According to embodiment of the present invention, the first sub-arm 114A and the second sub-arm 114B can also be connected to each other through a first connecting member 122, and the first connecting member 122 can connect the first sub-arm 114A with the second sub-arm 114B by a fastener (such as a linkage rod or a screw rod, but the present invention is not limited thereto).

According to an embodiment of the present invention, the third arm 118 can include a fifth sub-arm 118A and a sixth sub-arm 118B spaced apart along the third direction D3, and the fifth sub-arm 118A and the sixth sub-arm 118B can be pivotally connected through the second pivot member 126. In addition, the fourth arm 120 can include a seventh sub-arm 120A and an eighth sub-arm 120B spaced apart along the third direction D3, and the seventh sub-arm 120A and the eighth sub-arm 120B can be pivotally connected through the second pivot member 126. According to an embodiment of the present invention, the lower side of the third arm 118 is fixedly disposed on the base 102 at a second fixed end 132.

Referring to FIGS. 3-4, according to an embodiment of the present invention, the first sub-arm 114A and the third sub-arm 116A can be cross-connected to each other, and the second sub-arm 114B and the fourth sub-arm 116B can be cross-connected to each other. According to an embodiment of the present invention, the fifth sub-arm 118A and the seventh sub-arm 120A can be cross-connected to each other, and the sixth sub-arm 118B and the eighth sub-arm 120B can be cross-connected to each other. According to an embodiment of the present invention, the first sub-arm 114A and the third sub-arm 116A forming the X-shaped connection can be rotated relative to each other through the first pivot member 124 (such as a shaft, but the present invention is not limited thereto). The second sub-arm 114B and the fourth sub-arm 116B forming the X-shaped connection can be rotated relative to each other through the first pivot member 124. The fifth sub-arm 118A and the seventh sub-arm 120A forming the X-shaped connection can be rotated relative to each other through the second pivot member 128 (such as a shaft, but the present invention is not limited thereto). The sixth sub-arm 118B and the eighth sub-arm 120B forming the X-shaped connection can be rotated through the second pivot member 128. As a result, the X-shaped connection is able to cooperate with the operation of the actuator 110.

Referring to FIGS. 1-5, the actuator 110 can be connected obliquely to an upper part of the first arm 114 and the base 102. Alternatively, referring to FIG. 6, the actuator 110 can be connected obliquely to the upper part of the first arm 114 and a lower part of the third arm 118. Please refer to FIGS. 1-6, the actuator 110 can drive the movable platform 104 to move along the first direction D1 or the opposite direction of the first direction D1. More specifically, one side of the actuator 110 is connected with the first connecting member 122, and another side of the actuator 110 is connected with the base 102 or the lower part of the third arm 118 (as shown in FIG. 6). When the actuator 110 is extended or retracted, the actuator 110 can drive the movable platform 104 to move up and down relative to the base 102, so as to achieve the heave motion. The actuator 110 is arranged as a reclining arrangement instead of a vertical or flat arrangement, which can effectively reduce the height of the motion simulating apparatus, such that the height of the installation space occupied by the motion simulating apparatus can also be reduced. The actuator 110 can be an electric cylinder, an oil cylinder, a pneumatic cylinder, a motor (such as geared motor or stepper motor) or other device capable of transforming energy into a controllable displacement.

Referring to FIGS. 1-6, the rod 112 can substantially connect the upper part of the first arm 114 and the upper part of the third arm 118 horizontally. When the actuator 110 is actuated, the base 102, the movable platform 104, the first arm 114 and the third arm 118 are substantially in the shape of a parallelogram. According to an embodiment of the present invention, the base 102, the movable platform 104 and the rod 112 are all substantially parallel to the second direction D2, the length of the rod 112 is substantially equal to a distance H between the first fixed end 130 and the second fixed end 132, and the first arm 114 and the third arm 118 are also substantially parallel to each other and have the same length. Therefore, the first arm 114, the rod 112, the third arm 118 and the two fixed ends (the first fixed end 130 and the second fixed end 132) can form a parallelogram substantially. In this way, when the actuator 110 is extended or retracted, the movable platform 104 can be ensured to be moved up and down horizontally and stably. According to other embodiments, the configuration of the rod 112 may be one rod or multiple rods, and the purpose of the configuration of the rod(s) is to enable the first cross arm assembly 106 and the second cross arm assembly 108 to be move smoothly and synchronously, so as to ensure that the movable platform 104 can be moved up and down horizontally and stably.

According to an embodiment of the present invention, a first roller assembly 134 comprising multiple rollers can be disposed on the upper part of the first arm 114 and the lower part of the second arm 116 respectively, and a second roller assembly 136 comprising multiple rollers can be disposed on the upper part of the third arm 118 and the lower part of the fourth arm 120 respectively. Referring to FIGS. 1, 3, 4 and 6, according to an embodiment of the present invention, the first cross arm assembly 106 with the first roller assembly 134 is arranged on the left side of the actuator 110, and the second cross arm assembly 108 with the second roller assembly 136 is arranged on the right side of the actuator 110. The installation directions of the first cross arm assembly 106 and the second cross arm assembly 108 are the same direction. Referring to FIG. 1, the first roller assembly 134 of the first cross arm assembly 106 is on the right side relative to the fixed end (such as the first fixed end 130), and the second roller assembly 136 of the second cross arm assembly 108 is also on the right side relative to the fixed end (such as the second fixed end 132). It is worth noting that the first cross arm assembly 106 and the second cross arm assembly 108 are not limited to the aforementioned arrangement. According to another embodiment, the first cross arm assembly 106 with the first roller assembly 134 and the second cross arm assembly 108 with the second roller assembly 136 may be on the left side relative to the fixed end, so that the side of the rod 112 connected to the first arm 114 and the third arm 118 is movable relative to the base 102. The actuator 110 can drive the first arm 114 and the third arm 118 through the rod 112 to move along the second direction D2 or the opposite direction of the second direction D2, in order to elevate the movable platform 104. The rod 112 is configured to drive the first cross arm assembly 106 and the second cross arm assembly 108 to be extended and retracted stably in cooperation with the operation of the actuator 110, so the rod 112 must be arranged on the side with the roller assembly (the first roller assembly 134 or the second roller assembly 136), that is, the arrangement of the upper part of the first arm 114 and the upper part of the third arm 118 as shown in FIGS. 1-6.

Please referring to FIG. 3 more specifically, first rollers 134*a*, 134*b* can be disposed on the upper part of the first sub-arm 114A and the upper part of the second sub-arm 114B respectively. The first rollers 134*a*, 134*b* can be installed on a rod between the upper part of the first sub-arm 114A and the upper part of the second sub-arm 114B. First rollers 134*c*, 134*d* can be disposed on the lower part of the third sub-arm 116A and the lower part of the fourth sub-arm 116B respectively. Referring to FIGS. 3-5, second rollers 136*a*, 136*b* can be disposed on the upper part of the fifth sub-arm 118A and the upper part of the sixth sub-arm 118B respectively, and the second rollers 136*a*, 136*b* can be installed on a rod between the upper part of the fifth sub-arm 118A and the upper part of the sixth sub-arm 118B. Second rollers 136*c*, 136*d* can be disposed on the lower part of the seventh sub-arm 120A and the lower part of the eighth sub-arm 120B respectively so as to facilitate compact assembly. Furthermore, the arrangement of the first roller assembly 134 and the second roller assembly 136 can cooperate with the extension or retraction of the actuator 110, the first roller assembly 134 and the second roller assembly 136 can perform horizontal reciprocating movement, so that the movable platform 104 can be moved up and down smoothly.

Referring to FIGS. 1-6, according to an embodiment of the present invention, a first supporting member 138 can be disposed between the second arm 116 and the base 102, and a second supporting member 140 can be disposed between the fourth arm 120 and the base 102. More specifically, the first supporting member 138 can be disposed on the base 102 and disposed under the first rollers 134*c*, 134*d* of the third sub-arm 116A and the fourth sub-arm 116B; and the second supporting member 140 can be disposed on the base 102 and disposed under the second rollers 136*c*, 136*d* of the seventh sub-arm 120A and the eighth sub-arm 120B, thereby providing support and moving space for the first rollers 134*c*, 134*d* and the second rollers 136*c*, 136*d*. It is worth noting that the two supporting members 138, 140 are not limited to the aforementioned arrangement.

In conjunction with FIGS. 1-6, FIG. 7 shows a perspective view illustrating an embodiment of an actuating system. FIG. 8 shows an enlarged view illustrating a portion of the actuating system. Referring to FIGS. 1-7, the actuating system 150 can include an occupant platform 160, a plurality of motion simulating apparatus 100 and a plurality of joint assemblies 170. The actuating system 150 can carry occupants or passengers and generate motions along different directions, which is applicable for applications such as simulating platforms or amusement equipment. The occupant platform 160 is pivotally connected to the plurality of motion simulating apparatus 100 via the plurality of joint assemblies 170, and the occupant platform 160 is applied to carry one or more occupants or passengers. The occupant platform 160 is pivotally connected to the plurality of joint assemblies 170, so that the occupant platform 160 can pivot around the second direction D2 relative to the plurality of joint assemblies 170 and the plurality of motion simulating apparatus 100. It is noted that, the joint assembly 170 is a kind of joint structure. The joint structure being used for pivoting is known to those skilled in the art, so details related to this are not explained further herein.

Referring to FIG. 7, according to a symmetrical arrangement of an embodiment, the actuating system 150 can include two motion simulating apparatuses 100, the two motion simulating apparatuses 100 may be symmetrically disposed at two opposite sides of the occupant platform 160 respectively, and pivotally connected to the occupant platform 160. According to the configuration of the two motion simulating apparatuses 100, the actuator 110 may apply a force on the occupant platform 160 so as to generate a torque to drive the occupant platform 160 to be rotated around the second direction D2, and/or moved along the first direction D1 or the opposite direction of the first direction D1. For example, the two actuators 110 can be operated to generate synchronous and identical procedure to cause the occupant platform 160 to be moved up and down along the first direction D1 or the opposite direction of the first direction D1 relative to the base 102, and the two actuators 110 can be operated to generate different procedures to cause the occupant platform 160 to rotate around a pivot axis of the second direction D2 relative to the base 102. Based on the arrangement of the occupant platform 160, the simulating apparatus 100 and the plurality of joint assemblies 170 as described herein, the actuating system 150 can have a simple construction capable of simulating heave and roll motions with the plurality of simulating apparatuses 100. This configuration is applicable for simulating somatosensory experiences (such as elevator lifting, flying carpet, surfing, and flying, but are not limited thereto).

Referring to FIGS. 7-8, according to an embodiment of the present invention, the actuating system 150 further includes a plurality of slide assemblies 180, the slide assemblies 180 (such as slide rails but not limited thereto) are fixed below one side of the occupant platform 160, and the joint assemblies 170 is slidably disposed on the slide assemblies 180, so that the actuating system 150 can perform substantially horizontal movement. In this way, when the motion simulating apparatus 100 simulates the motions of heave and roll, the occupant platform 160 can be slid relative to at least one of the plurality of joint assemblies 170, so as to prevent the actuation system 150 from fracture due to rigidity issues. The arrangement of the sliding assembly 180 is not limited to the above embodiments.

Referring to FIGS. 7-8, according to an embodiment of the present invention, the actuating system 150 can further include a plurality of pillars 190 disposed between the occupant platform 160 and the base 102. A plurality of cushioning members 192 can also be disposed between the plurality of pillars 190 and the occupant platform 160, so that when an abnormal mechanical operation is occurred on the actuation system 150, the cushioning members 192 can buffer at least one impact between the occupant platform 160 and the motion simulating apparatus 100. In this configuration, the range of the occupant platform's 160 downward movement (such as the opposite direction of the first direction D1) is controlled, so as to improve the safety of the actuation system 150. Furthermore, the plurality of cushioning members 192 can also provide a cushioning function, so that occupants or passengers sitting on the occupant platform 160 could have a more comfortable experience.

It is worth noting that the actuation system 150 is not limited to the aforementioned arrangement. According to another embodiment of the present invention, the actuation system 150 may also have a plurality of motion simulating apparatuses 100 arranged asymmetrically (not shown in FIGS.) to drive the occupant platform 160 to move and/or rotate.

Advantages of the structures described herein include the ability to provide a motion simulating apparatus that is relatively simple in construction, and can be manufactured with reduced cost. Moreover, the motion simulating apparatus described can move smoothly and stably, and the height of the motion simulating apparatus can be reduced such that the installation space occupied by the motion simulating apparatus can also be reduced. Therefore, the motion simulating apparatus may be particularly suitable for use in environments of limited space. According to above arrangement, the motion simulating apparatus described herein is suitable for use with actuating systems to achieve the motion experiences of heave and roll.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A motion simulating apparatus comprising:

a base;

a movable platform arranged above the base;

a first cross arm assembly, disposed on a first side between the base and the movable platform, wherein the first cross arm assembly includes a first arm and a second arm that are cross-connected to each other;

a second cross arm assembly, disposed on a second side between the base and the movable platform relative to the first side, wherein the second cross arm assembly includes a third arm and a fourth arm that are cross-connected to each other;

an actuator, connected obliquely to an upper part of the first arm and the base or a lower part of the third arm, configured to drive the movable platform to move along a first direction or an opposite direction of the first direction; and a rod, horizontally connected with the upper part of the first arm and an upper part of the third arm, wherein the base, the movable platform, the first arm and the third arm substantially form a parallelogram when the actuator is actuating.

2. The motion simulating apparatus of claim 1, further comprising:

a first roller assembly, disposed on the upper part of the first arm and a lower part of the second arm; and a second roller assembly, disposed on the upper part of the third arm and a lower part of the fourth arm, wherein the first roller assembly and the second roller assembly are configured to be moved along a second direction or an opposite direction of the second direction when the actuator is actuating, so as to elevate the movable platform.

3. The motion simulating apparatus of claim 2, wherein when the actuator is actuating, the movable platform and the rod are substantially parallel to the second direction.

4. The motion simulating apparatus of claim 1, wherein the first arm and the third arm are substantially parallel to each other and respectively connected to the base at two fixed ends, and the length of the rod is substantially equal to the distance between the two fixed ends.

5. The motion simulating apparatus of claim 1, wherein the first arm comprises a first sub-arm and a second sub-arm spaced apart along a third direction, and the first sub-arm and the second sub-arm are pivotally connected through a first pivot member; and wherein the second arm comprises a third sub-arm and a fourth sub-arm spaced apart along the third direction, and the third sub-arm and the fourth sub-arm are pivotally connected through the first pivot member.

6. The motion simulating apparatus of claim 1, wherein the third arm comprises a fifth sub-arm and a sixth sub-arm spaced apart along a third direction, and the fifth sub-arm and the sixth sub-arm are pivotally connected through a second pivot member; and wherein the fourth arm comprises a seventh sub-arm and a eighth sub-arm spaced apart along the third direction, and the seventh sub-arm and the eighth sub-arm are pivotally connected through the second pivot member.

7. The motion simulating apparatus of claim 5, wherein the first sub-arm and the third sub-arm are cross-connected to each other, and the second sub-arm and the fourth sub-arm are cross-connected to each other.

8. The motion simulating apparatus of claim 6, wherein the fifth sub-arm and the seventh sub-arm are cross-connected to each other, and the sixth sub-arm and the eighth sub-arm are cross-connected to each other.

9. The motion simulating apparatus of claim 2, further comprising:

a first supporting member, disposed between the second arm and the base; and a second supporting member, disposed between the fourth arm and the base;

wherein the first supporting member is configured to support the first roller assembly, and the second supporting member is configured to support the second roller assembly.

10. The motion simulating apparatus of claim 5, wherein the first direction, the second direction and the third direction are substantially orthogonal to each other.

11. The motion simulating apparatus of claim 6, wherein the first direction, the second direction and the third direction are substantially orthogonal to each other.

12. The motion simulating apparatus of claim 2, wherein the first cross arm assembly forms an X-shaped connection, the second cross arm assembly forms an X-shaped connection, and the first cross arm assembly and the second cross arm assembly are arranged in a same direction.

13. An actuating system comprising:

an occupant platform, adapted to carry one or more occupants; and a plurality of the motion simulating apparatus of claim 1, wherein the movable platform of the motion simulating apparatus is pivotally connected to the occupant platform through a plurality of joint assemblies.

14. The actuating system of claim 13, wherein the actuator of the motion simulating apparatus is operable to drive the occupant platform to move along the first direction or the opposite direction of the first direction.

15. The actuating system of claim 13, wherein the actuator of the motion simulating apparatus is operable to drive the occupant platform to rotate about a pivot axis of the second direction.

16. The actuating system of claim 13, further comprising:

a plurality of slide assemblies, disposed between the occupant platform and the plurality of joint assemblies, wherein the occupant platform is substantially moved along the third direction or the opposite direction of the third direction relative to at least one of the plurality of joint assemblies.

* * * * *